US007223454B1

(12) United States Patent
Bringley et al.

(10) Patent No.: US 7,223,454 B1
(45) **Date of Patent: *May 29, 2007**

(54) INK JET RECORDING ELEMENT WITH CORE SHELL PARTICLES

(75) Inventors: Joseph F. Bringley, Rochester, NY (US); Olivier Jean Poncelet, Chalon sur Saone (FR); Gérard Friour, Chalon sur Saone (FR); Lori Shaw-Klein, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 263 days.

This patent is subject to a terminal disclaimer.

(21) Appl. No.: 10/622,352

(22) Filed: Jul. 18, 2003

(51) Int. Cl.
*B41M 5/50* (2006.01)

(52) U.S. Cl. ..... 428/32.36; 428/32.15; 428/32.25; 428/195.1

(58) Field of Classification Search ..... None
See application file for complete search history.

(56) References Cited

U.S. PATENT DOCUMENTS

| | | | | |
|---|---|---|---|---|
| 3,956,171 | A * | 5/1976 | Moore et al. | 516/80 |
| 5,372,884 | A | 12/1994 | Abe et al. | |
| 6,419,355 | B1 * | 7/2002 | Bermel et al. | 347/105 |
| 2005/0238559 | A1 * | 10/2005 | Poncelet et al. | 423/328.1 |
| 2006/0045833 | A1 * | 3/2006 | Poncelet et al. | 423/328.1 |

FOREIGN PATENT DOCUMENTS

| | | |
|---|---|---|
| EP | 0 965 460 | 12/1999 |
| EP | 1 016 543 | 7/2000 |
| EP | 1 138 512 A1 | 10/2001 |
| EP | 1 319 517 A1 | 6/2003 |

* cited by examiner

*Primary Examiner*—Pamela R. Schwartz
(74) *Attorney, Agent, or Firm*—Andrew J. Anderson; Paul A. Leipold

(57) ABSTRACT

An image recording element having a support having thereon an image-receiving layer, the recording element containing core/shell particles wherein the shell of the particles is an oligomeric or polymeric aluminosilicate complex or an aluminosilicate particulate, the complex and the particulate having a positive charge and being counter balanced by an anion.

13 Claims, No Drawings

INK JET RECORDING ELEMENT WITH CORE SHELL PARTICLES

CROSS REFERENCE TO RELATED APPLICATIONS

Reference is made to commonly assigned, co-pending U.S. patent applications:

Ser. No. 10/622,230 by Bringley et al., now U.S. Pat. No. 6,916,514 filed of even date herewith entitled "Cationic Shell Particle".

Ser. No. 10/622,354 by Bringley et al., filed of even date herewith entitled "Colloidal Core Shell Assemblies and Methods of Preparation", now abandoned.

Ser. No. 10/622,234 by Bringley et al., now U.S. Pat. No. 6,890,610 filed of even date herewith entitled "Ink Jet Recording Element".

FIELD OF THE INVENTION

The present invention relates to an ink jet recording element containing core/shell particles which improve stability and optical density.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer. Another problem with a porous recording element is that atmospheric gases or other pollutant gases readily penetrate the element and lower the optical density of the printed image causing it to fade.

EP 1 016 543 relates to an ink jet recording element containing aluminum hydroxide in the form of boehmite. However, there is a problem with this element in that it is not stable to light and exposure to atmospheric gases.

EP 0 965 460A2 relates to an ink jet recording element containing aluminum hydrate having a boehmite structure and a non-coupling zirconium compound. However, there is no specific teaching of polymeric aluminosilicate complexes as described herein.

U.S. Pat. No. 5,372,884 relates to ink jet recording elements containing a cation-modified acicular or fibrous colloidal silica, wherein the cation-modifier is at least one hydrous metal oxide selected from the group consisting of hydrous aluminum oxide, hydrous zirconium oxide and hydrous tin oxide. However, there is no specific teaching of teaching of polymeric aluminosilicate complexes as described herein.

PROBLEM TO BE SOLVED

There is a need for ink receiving elements that have improved usage stability as well as good dry time and image quality.

SUMMARY OF THE INVENTION

It is an object of this invention to provide an ink jet recording element that, when printed with dye-based inks, provides superior optical densities, good image quality, image stability, and has an excellent dry time.

This and other objects are achieved in accordance with the invention which comprises an image recording element comprising a support having thereon an image-receiving layer, the recording element containing core/shell particles wherein the shell of the particles consists of an oligomeric or polymeric aluminosilicate complex or an aluminosilicate particulate, the complex and the particulate having a positive charge and being counter balanced by an anion.

ADVANTAGEOUS EFFECT OF THE INVENTION

By use of the invention, an ink jet recording element is obtained that, when printed with dye-based inks, provides superior image stability and optical densities, good image quality and has an excellent dry time.

DETAILED DESCRIPTION OF THE INVENTION

In a preferred embodiment of the invention, the core/shell particles consist of a core particle having a negative charge upon its surface and having thereon a shell. Core particles useful in the invention include silica, zinc oxide, zirconium oxide, titanium dioxide, barium sulfate, and clay minerals such as montmorillonite. In a preferred embodiment of the invention, the core particles are negatively charged. One skilled in the art can determine the conditions favorable for inducing a negative charge onto various inorganic or organic particles in such a way that they can be used as core particles for shelling polymeric aluminosilicate complexes. In a particularly preferred embodiment of the invention, the core particles consist of silica, such as silica gel, hydrous silica, fumed silica, colloidal silica, etc. The size of the core particles may be from about 0.01 to about 10 μm, preferably from about 0.05 to about 1.0 μm.

The shell, as described above, may comprise about 0.1 to about 50% by weight, based upon the weight of the core particle, but is preferably from about 3 to about 40% by weight of the core particle, more preferably about 10 to about 30% by weight. The shell may have a thickness of about 0.005 to about 0.500 μm, preferably about 0.01 to 0.100 um thick.

In a preferred embodiment of the invention, the core/shell particles described above are located in the image-receiving layer. In another preferred embodiment, the polymeric or oligomeric aluminosilicate complex has the formula:

$$Al_xSi_yO_a(OH)_b \cdot nH_2O$$

where the ratio of x:y is between 0.5 and 4, a and b are selected such that the rule of charge neutrality is obeyed; and n is between 0 and 10.

In another preferred embodiment, the polymeric or oligomeric aluminosilicate complex is synthetic or naturally occurring hydrous aluminosilicate minerals, both crystalline and amorphous, including imogolite, proto-imogolite, allophane, halloysite, or hydrous feldspathoid.

In yet another preferred embodiment, the polymeric or oligomeric aluminosilicate complex has the formula:

$$Al_xSi_yO_a(OH)_b \cdot nH_2O$$

where the ratio of x:y is between 1 and 3, and a and b are selected such that the rule of charge neutrality is obeyed; and n is between 0 and 10.

The polymeric or oligomeric aluminosilicate can be obtained by the controlled hydrolysis by an aqueous alkali solution of a mixture of an aluminum compound such as halide, perchloric, nitrate, sulfate salts or alkoxides species $Al(OR)_3$, and a silicon compound such as alkoxides species, wherein the molar ratio Al/Si is maintained between 1 and 3.6 and the alkali/Al molar ratio is maintained between 2.3 and 3. Such materials are described in French patent application FR 02/9085 (docket 82642).

The polymeric or oligomeric aluminosilicate can be obtained by the controlled hydrolysis by an aqueous alkali solution of a mixture of an aluminum compound such as halide, perchloric, nitrate, sulfate salts or alkoxides species $Al(OR)_3$ and a silicon compound made of mixture of tetraalkoxide $Si(OR)_4$ and organotrialkoxide $R'Si(OR)_3$, wherein the molar ratio is maintained between 1 and 3.6 and the alkali/Al molar ratio is maintained 2.3 and 3. Such materials are described in French patent application FR 02/9086 (docket 82641).

It is further possible to age or heat treat suspensions of the core/shell materials to obtain core/shell particulates ranging in size from about 0.500 μm to 5.0 μm. Preferred particles sizes are in the range from about 5 nm to 1000 nm, more preferably from about 50 to about 300 nm because particles of that size have good gloss and porosity. Calcination of amorphous metal (oxy)hydroxide leads to the formation of crystalline polymorphs of metal oxides.

In a preferred embodiment of the invention, the image-receiving layer is porous and also contains a polymeric binder in an amount insufficient to alter the porosity of the porous receiving layer. In another preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar—agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, or a poly(alkylene oxide). In yet still another preferred embodiment, the hydrophilic binder is poly(vinyl alcohol).

In addition to the image-receiving layer, the recording element may also contain a base layer, next to the support, the function of which is to absorb the solvent from the ink. Materials useful for this layer include particles, polymeric binder and/or crosslinker.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 μm, preferably from about 75 to 300 μm to provide good stiffness. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The image-receiving layer employed in the invention can contain one or more mordanting species or polymers. The mordant polymer can be a soluble polymer, a charged molecule, or a crosslinked dispersed microparticle. The mordant can be non-ionic, cationic or anionic.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir. While preferred for ink jet use, the paper also could be utilized in other imaging systems. Typical of such use would be in lithographic imaging, electrophotographic, flexigraphic, and thermal imaging techniques.

The following examples are provided to illustrate the invention.

EXAMPLES

Example 1

Dye Stability Evaluation Tests

The dye used for testing was a magenta colored ink jet dye having the structure shown below. To assess dye stability on a given substrate, a measured amount of the ink jet dye and solid particulates or aqueous colloidal dispersions of solid particulates (typically about 10%–20.0% by weight solids) were added to a known amount of water such that the concentration of the dye was about $10^{-5}$ M. The solid dispersions containing dyes were carefully stirred and then spin coated onto a glass substrate at a speed of 1000–2000 rev/min. The spin coatings obtained were left in ambient atmosphere with fluorescent room lighting (about 0.5 Klux) kept on at all times during the measurement. The fade time was estimated by noting the time required for complete disappearance of magenta color as observed by the naked eye. Another way of determining face would be by noting the time required for the optical absorption to decay to less than 0.03 of the original value.

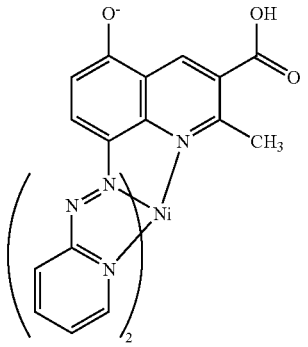

Magenta Dye

Comparative Coatings C-1 to C-3 (Non-Core/Shell Colloidal Particles)

C-1 an aqueous dispersion of fumed alumina, $Al_2O_3$, having the trade name PG001, was purchased from Cabot Corporation and used as received. C-2 Boehmite, AlO(OH), was purchased under the trade name Catapal 200®, from Sasol North America Inc. Dispersions of Catapal 200® in distilled water were made at a solids content of 10–35% (weight/weight); the dispersion had a mean particle size of about 85 nm, a pH of 3.4–3.8, and specific gravity from about 1.1–1.3 g/ml. C-3 a colloidal dispersion of silica particles was obtained from Nalco Chemical Company, having the trade name NALCO 2329®. The colloid had a mean particle size of 90 nm, a pH of 8.4, specific gravity of 1.3 g/ml, and a solids content of 40%. Another silica colloid used was NALCO TX11005® which had a mean particle size of 110 nm, a pH of 9.6, specific gravity of 1.3 g/ml, and a solids content of 41%.

The colloidal dispersions were used as received and coated and tested as described above and the results shown in Table 1 below.

Preparation of Aluminosilicate Polymers

Aluminosilicate polymer colloid A in 100 L of osmosed water, contained in a plastic (polypropylene) reactor vessel, was dissolved 4.53 moles $AlCl_3.6H_2O$. After dissolution, 2.52 moles, tetraethyl orthosilicate were added. This mixture was stirred and circulated simultaneously through a bed formed of 1 kg of glass beads (2-mm diameter) using a pump with 8-l/min output. The operation to prepare the unmodified mixed aluminum and silicon precursor took 90 minutes. Then, 10.5 moles of 3.0 M aqueous NaOH were added to the contents of the reactor over two hours. Aluminum concentration was $4.4\times10^{-2}$ mol/l, Al/Si molar ratio 1.8 and alkali/Al ratio 2.31. The reaction medium became cloudy in appearance. The mixture was stirred for 48 hours and the medium became clear. The circulation was stopped in the glass bead bed. The medium was then concentrated by a factor of 3 by nanofiltration, then diafiltration using a Filmtec NF 2540 nanofiltration membrane (surface area 6 $m^2$) to eliminate the sodium salts and to obtain an Al/Na ratio greater than 100. The retentate resulting from the diafiltration by nanofiltration was concentrated to obtain a gel with about 20.1% by weight of aluminosilicate polymer.

Aluminosilicate polymer colloid B. 4.53 moles $AlCl_3.6H_2O$ were added to 100 L osmosed water. Separately, a mixture of tetraethyl orthosilicate and methyltriethoxysilane was prepared in a quantity corresponding to 2.52 moles silicon and so as to have a ratio of tetraethyl orthosilicate to methyltriethoxysilane of 1:1 in moles silicon. This mixture was added to the aluminum chloride solution. The resulting mixture was stirred and circulated simultaneously through a bed formed of 1-kg glass beads (2-mm diameter) using a pump with 8-l/min output. The operation of preparing the modified mixed aluminum and silicon precursor took 120 minutes. Then, 10.5 moles of 3.0 M aqueous NaOH was added over hours. The reaction medium became cloudy in appearance. The mixture was stirred for 24 hours and the medium became clear. The circulation was stopped in the glass bead bed. Then, 3.09 moles NaOH 3M were added over ten minutes. The aluminum concentration was $4.3\times10^{-2}$ mol/l, Al/Si molar ratio 1.8, and alkali/Al ratio 3. The hybrid aluminosilicate polymer material was thus obtained in suspension form. This polymer suspension is left to settle for 24 hours, then the supernatant is discarded to recover the sediment. Then 2 liters of an $HCl/CH_3COOH$ M/2M mixture were added to this sediment to obtain a dispersion of the aluminosilicate polymer. The dispersion was then diafiltrated using a Filmtec NF 2540 nanofiltration membrane (surface area 6 $m^2$) to eliminate the sodium salts to achieve an Al/Na ratio greater than 100. Then the retentate resulting from the diafiltration by nanofiltration was concentrated to obtain a gel with about 20% by weight of aluminosilicate polymer Preparation of Core/Shell Particles Inventive Coatings I-1 to I-2 (Aluminosilicate Surface-Modified Particles)

I-1. Into a 2.0 L container containing 200 ml of distilled water which was stirred with a prop-like stirrer at a rate of 2000 rpm was simultaneously added Nalco 2329 silica at a rate of 20.00 ml/min for 25 minutes and an aluminosilicate polymer colloid A at a rate of 8.0 ml/min for 25 minutes. The weight ratio of the resulting colloid was therefore 86% silica and 14% aluminosilicate polymer. The resulting dispersion had an average particle size of 180 nm and did not settle after standing, indicating that the dispersion was a stable colloid. The zeta potential of the colloidal particles was found to be about +38 mV at a pH of about 4.0, indicating that the particles were positively charged. These data also indicate that the sign of the charge of the particles is reversed by the shelling process as the core particles had a zeta potential of −40 mV at a pH=8.0. The resulting dispersion was then coated and tested as described above and the results shown in Table 1 below.

I-2. Into a 2.0 L container containing 200 ml of distilled water which was stirred with a prop-like stirrer at a rate of 2000 rpm was simultaneously added Nalco TX11005 silica at a rate of 20.00 ml/min for 20 minutes and an aluminosilicate polymer colloid B (diluted to 11.6% solids) at a rate of 27.8 ml/min for 20 minutes. The weight ratio of the resulting colloid was therefore 76% silica and 24% aluminosilicate polymer. The resulting dispersion had an average particle size of 150 nm and did not settle after standing, indicating that the dispersion was a stable colloid. The resulting dispersion was then coated and tested as described above and the results shown in Table 1 below.

TABLE 1

| Coating | Core Particle | Shell Particle | Core/Shell Ratio | Particle Size (nm) | Particle Charge | Fade Time |
|---|---|---|---|---|---|---|
| C-1 | $Al_2O_3$ | none | 100/0 | 230 | pos. | 18 h |
| C-2 | AlO (OH) | none | 100/0 | 80 | pos. | 24 h |
| C-3 | $SiO_2$ | none | 100/0 | 90 | neg. | 18 h |
| C-4 | $SiO_2$ | none | 100/0 | 110 | neg. | 18 h |
| I-1 | $SiO_2$ | alumino-silicate polymer A | 86/14 | 180 | pos. | 5 d |
| I-2 | $SiO_2$ | alumino-silicate polymer B | 76/24 | 150 | pos. | >30 d |

Example 2

Preparation Base Coat Coating Solution:

A coating solution was prepared by mixing (1) 242.6 g of water (2) 225.6 g of Albagloss-s® precipitated calcium carbonate (Specialty Minerals Inc.) at 70 wt. %.

(3) 8.75 g of silica gel Crossfield 23F® (Crossfield Ltd.)

(4) 8.75 g of Airvol 125® poly(vinyl alcohol) (Air Products) at 10 wt. %

(5) 14.3 g of styrene-butadiene latex CP692NA® (Dow Chemicals Ltd.) at 50 wt. %.

Image Receiving Layer Coating Solution 1:

Image receiving coating solution 1 was prepared by combining 127.5 g deionized water, 34.5 g of high purity alumina (Catapal® 200, Sasol), 10.2 g of a 10% solution of polyvinyl alcohol (Gohsenol GH-17, Nippon Gohsei) 3.8 g of a core/shell particle emulsion (silica core and poly(butyl acrylate) shell, 40% solids) as prepared by the procedure as described in the Example 1 of U.S. Pat. No. 6,440,537, 13.6 g of poly(vinylbenzyl trimethylammonium chloride-co-divinylbenzene) (87:13 molar ratio) emulsion (15% solids), 9.8 g of poly(styrene-co-vinylbenzyl dimethylbenzylammonium chloride-co-divinylbenzene) (49.5:49.5:1.0 molar ratio) emulsion (20% solids), 0.26 g Silwet L-7602® and 0.42 g Silwet L-7230® surfactants. Poly(vinylbenzyl trimethylammonium chloride-co-divinylbenzene) (87:13 molar ratio) is a cationic polymer particle having a mean particle size of about 65 nm and a benzyl trimethyl ammonium moiety. Poly(styrene-co-vinylbenzyl dimethylbenzylammonium chloride-co-divinylbenzene) is a cationic polymer particle having a mean size of about 60 nm and a benzyl dimethylbenzylammonium moiety.

Image Receiving Layer Coating Solution 2:

Image receiving coating solution 2 was prepared as in Image receiving coating solution 1 except 40.6 g of aluminosilicate-shelled colloidal silica dispersion (21.2% solids) was used to replace 8.6 g of the Catapal® alumina. The ratio of aluminosilicate-shelled colloidal silica dispersion to Catapal® alumina was therefore 25/75. The deionized water level was adjusted to bring the total solids concentration to the same level as Image receiving coating solution 1.

Image Receiving Layer Coating Solution 3:

Image receiving coating solution 3 was prepared as in Image receiving coating solution 1 except 81.4 g of aluminosilicate-shelled colloidal silica dispersion (21.2% solids) was used to replace 17.25 g of the Catapal® alumina. The ratio of aluminosilicate-shelled colloidal silica dispersion to Catapal® alumina was therefore 50/50. The deionized water level was adjusted to bring the total solids concentration to the same level as Image receiving coating solution 1.

Image Receiving Layer Coating Solution 4:

Image receiving coating solution 4 was prepared as in Image receiving coating solution 1 except 122.2 g of aluminosilicate-shelled colloidal silica dispersion (27.5% solids) was used to replace 25.9 g of the Catapal® alumina. The ratio of aluminosilicate-shelled colloidal silica dispersion to Catapal® alumina was therefore 75/25. The deionized water level was adjusted to bring the total solids concentration to the same level as Image receiving coating solution 2.

Image Receiving Layer Coating Solution 5:

Image receiving coating solution 5 was prepared as in Image receiving coating solution 1 except 162.7 g of aluminosilicate-shelled colloidal silica dispersion (27.5% solids) was used to replace all of the Catapal® alumina. The ratio of aluminosilicate-shelled colloidal silica dispersion to Catapal® alumina was therefore 100/0. The deionized water level was adjusted to bring the total solids concentration to the highest possible concentration.

Preparation of Ink Jet Recording Elements

Element C-1 (Control)

Base layer coating solution 1 was coated onto a raw paper base which had been previously subjected to corona discharge treatment, and then dried at about 90° C. to give a dry thickness of about 25 μm or a dry coating weight of about 27 g/m$^2$.

Image receiving layer coating solution 1 was coated on the top of the base layer and dried at 90° C. to give a dry coating weight of about 5.6 g/m$^2$.

Element C-2 (Control)

Kodak Picture Paper, Soft Gloss (Catalog number 1124346).

Element 1 (Invention):

Element 1 was prepared as Element C-1 except that the image receiving coating solution 2 was used.

Element 2 (Invention):

Element 2 was prepared as Element C-1 except that the image receiving coating solution 3 was used.

Element 3 (Invention)

Element 3 was prepared as Element C-1 except that the image receiving coating solution 4 was used.

Element 4 (Invention)

Element 4 was prepared as Element C-1 except that the image receiving coating solution 5 was used.

Printing

Each of the above elements was printed using a Kodak Personal Picture Maker 200 ink jet printer. Each ink (cyan, magenta, and yellow) and process black (equal mixture of cyan, magenta and yellow) was printed in 6 steps of increasing density, and the optical density of each step was read. The samples were then placed together in a controlled atmosphere of 60 parts per billion ozone concentration, and the densities at each step reread after 24 hours. The percent density loss at a starting density of 1.0 was interpolated for each single dye and for each channel of the process black. The results are summarized in Table 2.

TABLE 2

| | Interpolated % Fade from Starting Density of 1.0 for 24 hrs. | | | | | |
|---|---|---|---|---|---|---|
| Element | C | M | Y | Cyan of process black | Magenta of Process black | Yellow of process black |
| C-1 | 1.7 | 27.4 | 2.0 | 1.8 | 25.3 | 1.5 |
| C-2 | 28.8 | 50.5 | 1.2 | 11.1 | 46.1 | 5.3 |
| 1 | 3.1 | 19.3 | 2.4 | 2.2 | 23.0 | 1.6 |
| 2 | 2.3 | 11.5 | 2.5 | 2.2 | 14.5 | 1.8 |
| 3 | 3.5 | 11.1 | 2.3 | 2.0 | 11.8 | 2.2 |
| 4 | 3.5 | 10.8 | 1.5 | 2.1 | 11.9 | 2.3 |

The above results show that the fade in the magenta channel is less for all of the invention examples than for either the control or control elements.

Example 3

Materials

An aqueous dispersion of colloidal silica, $SiO_2$, having the trade name Nalco 23299®, (Ondeo Nalco Corporation, 40% solids) was used as the core. An aluminosilicate polymer prepared as a 16.66% sol in deionized water was used as the shell.

Preparation of Coating Solutions

Image Receiving Layer Coating Solution 6

Image receiving coating solution 6 was prepared by combining 10.5 g de-ionized water, 7.5 g of colloidal silica sol Nalco 2329®, 4 g of a 9% solution of polyvinyl alcohol (Gohsenol GH-23®, Nippon Gohsei). The mixture is allowed to mill on a roller mixer for 12 hours in presence of 5, 10 mm glass beads.

Image Receiving Layer Coating Solution 7

Image receiving coating solution 7 was prepared as in image receiving coating solution 6 except 0.9 g of aluminosilicate polymer sol was used to replace 0.375 g of the colloidal silica sol. The ratio of aluminosilicate polymer to silica was therefore 5/95. The de-ionized water level was adjusted to bring the total solids concentration to the same level as Coating Solution 6.

Image Receiving Layer Coating Solution 8

Image receiving coating solution 8 was prepared as in image receiving coating solution 6 except 2.25 g of aluminosilicate polymer sol was used to replace 0.937 g of the colloidal silica sol. The ratio of aluminosilicate polymer to silica was therefore 12.5/87.5. The de-ionized water level was adjusted to bring the total solids concentration to the same level as Coating Solution 6.

Image Receiving Layer Coating Solution 9

Image receiving coating solution 9 was prepared as in image receiving coating solution 6 except 3.60 g of aluminosilicate polymer sol was used to replace 1.50 g of the colloidal silica sol. The ratio of aluminosilicate polymer to silica was therefore 20/80. The de-ionized water level was adjusted to bring the total solids concentration to the same level as Coating Solution 6.

Preparation of Inkjet Recording Elements

Element C-3 (Control)

Image receiving layer coating solution 6 was coated onto a polyethylene-coated base paper which had been previously subjected to a corona discharge treatment, and then dried at room temperature to give a dry coating weight of about 10 g/m2.

Element 7

Element 7 was prepared as Element 6 except that the image receiving coating solution 6 was used.

Element 8

Element 8 was prepared as Element 6 except that the image receiving coating solution 8 was used.

Element 9

Element 9 was prepared as Element 6 except that the image receiving coating solution 9 was used.

Printing

Each of the above elements was printed using a Kodak Personal Picture Maker 200 inkjet printer. Each ink (cyan, magenta, and yellow) was printed in 6 steps of increasing density, and the optical density of each step was read. The samples were then placed together in a controlled atmosphere of 60 parts per billion ozone concentration, and the densities at each step reread after 3 weeks. The percent density loss at a starting density of 0.5 was interpolated for each single dye. The results are summarized in Table 3 below. The gloss of each element was also analyzed at a 60° angle (gloss meter: Pico Gloss 560 from Erichsen). The results are listed in Table 3 below.

TABLE 3

| | Interpolated % Fade from Starting Density of 0.5 after 3 weeks | | | |
|---|---|---|---|---|
| Element | Magenta | Cyan | Yellow | 60° Gloss |
| C-3 | 95 | 85 | 0 | 48 |
| 7 | 90 | 41 | 0 | 57 |
| 8 | 45 | 12 | 0 | 63 |
| 9 | 0 | 2 | 0 | 67 |

The above results show that the fade in the magenta and cyan channels are less for all of the invention elements than for the control example. The yellow channel is not affected. The gloss is significantly improved for the inventive elements.

Although the invention has been described in detail with reference to certain preferred embodiments for the purpose of illustration, it is to be understood that variations and modifications can be made by those skilled in the art without departing from the spirit and scope of the invention.

What is claimed is:

1. An image recording element comprising a support having thereon an image-receiving layer, said recording element containing core/shell particles wherein said shell comprises polymeric aluminosilicate complex having the formula $$Al_xSi_yO_a(OH)_b \cdot nH_2O$$

where the ratio of x:y is between 0.5 and 4, a and b are selected such that the rule of charge neutrality is obeyed; and n is between 0 and 10, said complex having a positive charge and being counter balanced by an anion.

2. The recording element of claim 1 wherein said core/shell particles are present in said image-receiving layer.

3. The recording element of claim 2 wherein said image-receiving layer contains a polymeric binder.

4. The recording element of claim 3 wherein said core comprises silica.

5. The recording element of claim 4 wherein the polymeric aluminosilicate complex shell material comprises from about 10 to about 30% by weight of the core particles.

6. The recording element of claim 5 wherein the particle size of said core/shell particle is in the range from about 50 nm to about 300 nm.

7. The recording element of claim 1 wherein said core/shell particles are present in an overcoat layer.

8. The recording element of claim 1 wherein the polymeric aluminosilicate complex shell material comprises from about 3 to about 40% by weight of the core particles.

9. The recording element of claim 1 wherein the particle size of said core/shell particle is in the range from about 5 nm to about 1000 nm.

10. The recording element of claim 1 wherein said support is opaque.

11. The recording element of claim 1 wherein said support is transparent.

12. The recording element of claim 1 which also includes a base layer located between said image-receiving layer and said support.

13. The recording element of claim 1 wherein said image receiving layer is an ink jet receiving layer.

* * * * *